US006814517B2

(12) United States Patent
Fisher et al.

(10) Patent No.: US 6,814,517 B2
(45) Date of Patent: Nov. 9, 2004

(54) SINGLE PASS MULTI-COLOR PRINTER WITH IMPROVED CUTTING APPARATUS AND METHOD

(75) Inventors: Terrence L. Fisher, Rochester, NY (US); Eric P. Hochreiter, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/371,035

(22) Filed: Feb. 20, 2003

(65) Prior Publication Data

US 2004/0165927 A1 Aug. 26, 2004

(51) Int. Cl.[7] ..... B41J 11/70

(52) U.S. Cl. ..... 400/621; 400/593; 400/632; 400/645; 101/93.07; 83/614

(58) Field of Search ..... 400/621, 621.1, 400/630, 631, 632, 632.1, 645, 623, 645.1, 593; 101/93.07; 83/614

(56) References Cited

U.S. PATENT DOCUMENTS

| | | | | | |
|---|---|---|---|---|---|
| 934,292 | A | | 9/1909 | Dawes | |
| 1,745,442 | A | | 2/1930 | Orndoff | |
| 4,011,811 | A | * | 3/1977 | Kodis | 101/93.07 |
| 4,583,459 | A | * | 4/1986 | Abendroth et al. | 101/217 |
| 4,979,838 | A | * | 12/1990 | Yokota et al. | 400/621 |
| 5,042,345 | A | | 8/1991 | Hawkins et al. | |
| 5,379,056 | A | | 1/1995 | Walter et al. | |
| 5,440,328 | A | | 8/1995 | Nardone et al. | |
| 5,452,959 | A | * | 9/1995 | Oka | 400/149 |
| 5,699,741 | A | * | 12/1997 | Schmidt et al. | 101/485 |
| 5,711,620 | A | | 1/1998 | Sasaki et al. | |
| 5,847,742 | A | | 12/1998 | Nishimura | |
| 5,893,315 | A | | 4/1999 | Miller | |
| 6,046,756 | A | * | 4/2000 | Iga et al. | 347/173 |
| 6,079,309 | A | * | 6/2000 | Molburg | 83/745 |
| 6,132,121 | A | * | 10/2000 | Brings et al. | 400/621 |
| 6,339,982 | B1 | * | 1/2002 | Angel et al. | 83/76.9 |
| 6,616,360 | B2 | * | 9/2003 | Lehmkuhl | 400/621 |

* cited by examiner

*Primary Examiner*—Anthony H. Nguyen
*Assistant Examiner*—Dave A. Ghatt
(74) *Attorney, Agent, or Firm*—Norman Rushefsky; Mark G. Bocchetti

(57) ABSTRACT

A printing apparatus and method that provides for severing of prints from receiver media being printed. The receiver media is moved in a process direction past plural printing stations and the printing stations are recording images upon the receiver sheet. While printing is occurring a cutting mechanism having one or more cutting elements is operated to cut the receiver media along a transverse direction to separate a previously printed image on the receiver media from a portion of the receiver media being currently printed. The cutting mechanism includes a clamping member located proximate the one or more cutting elements for stopping movement of the receiver sheet downstream of the clamping mechanism to provide for a substantially square cut relative to the process direction of the receiver media.

9 Claims, 7 Drawing Sheets

SINGLE PASS MULTI-COLOR PRINTER WITH IMPROVED CUTTING APPARATUS AND METHOD

FIELD OF THE INVENTION

This application relates to printer apparatus and methods of printing, and more particularly to such apparatus and methods wherein images are printed on a continuously moving receiver member and after printing are severed into discrete sheets.

BACKGROUND OF THE INVENTION

In the prior art as exemplified by U.S. Pat. No. 5,440,328, there is described a thermal printing apparatus wherein a receiver member is formed as a roll of paper or coated paper and continuously fed through a series of color print stations wherein different color images, for example color separation images, are separately superimposed on an image area of the receiver member as the receiver member is moved from color station to color station. Thereafter, the receiver member with plural color images formed thereon in superposed registered relationship is delivered to a cutting device for separating the now imaged receiver member into discrete sheets. The problem with such apparatus is that, while one portion of the receiver member is receiving images and is in motion from one color print station to another color print station, another portion of the receiver member needs to be cut preferably while the receiver member is stationary.

In U.S. Pat. No. 1,745,442, there is disclosed a clamping device for a web cutting machine wherein a rotary cutter is provided for cutting the web. In order to cut the web a clamping device is provided which provides gripping members that extend for the width of the machine and are adapted to be brought in clamping relationship with the web by means of a cam drive. The cam drive is operated in conjunction with a rotating knife mechanism so that the clamping occurs at a proper timed relationship with respect to operation of the knife itself. In the device described in this patent a cam follower is associated with a swinging plate that is spring biased out of the path of the web. As a cutting action occurs, the cam urges the cam follower to move the swinging plate against the spring bias. The plate is supported so as to be pivoted about an axis that extends generally perpendicular to the direction of advancement of the web. A problem with the apparatus described in this patent is that the subject matter thereof is not related to printing and additionally the pivot axis of the clamping device needs to be relatively distant from the cutting device in order to be out of the path of the web in order to overcome sufficient moment force of the spring.

It is, therefore, an object of the invention to provide in an improved printing apparatus and method for cutting a moving receiver member as it is being printed.

SUMMARY OF THE INVENTION

The above objects are met in a printing apparatus having a cutter to sever the receiver member as printing is being made on the receiver member. In accordance with the printing apparatus of the invention a clamping device holds the receiver member as it is being cut by the cutter. In a first aspect of the invention, there is provided a printing apparatus comprising a plurality of printing stations arranged along a path of movement of a receiver sheet moving in a process direction and the printing stations being adapted to record images upon the receiver sheet; and a cutting mechanism having a cutting blade or blades positioned to cut the receiver sheet along a transverse direction to separate a previously printed image on the receiver sheet from a portion of the receiver sheet being currently printed, the cutting mechanism including a clamping member located proximate the cutting blade or blades for stopping movement of the receiver sheet downstream of the clamping mechanism to provide for a substantially square cut relative to the process direction of the receiver sheet.

In a preferred embodiment, a cam member rotates with operation of a rotary cutter. A lever arm includes a cam follower member that engages the cam member, the lever arm being pivotable about an axis that extends generally in the direction of movement of the receiver member immediately upstream of the clamping device. The lever arm engages a clamping member or a secondary lever which in turn engages the clamping member to control movement of the clamping member into engagement with the receiver member to hold the receiver member from movement while it is being cut by the rotary cutter.

In accordance with a second aspect of the invention, there is provided a method for cutting a receiver member in a printing apparatus while printing is being made on the receiver member. The method comprises operating a cutter to sever the receiver member and holding the receiver member as it is being cut by the cutter using a clamping device.

In a preferred embodiment of the method, a cam member is rotated with operation of a rotary cutter. A lever arm that includes a cam follower member engages the cam member. The lever arm pivots about an axis that extends generally in the direction of movement of the receiver member immediately upstream of the clamping device. The lever arm engages a clamping member or a secondary lever which in turn engages the clamping member control movement of the clamping member into engagement with the receiver member to hold the receiver member from movement while it is being cut by the rotary cutter.

DESCRIPTION OF THE PREFERRED EMBODIMENTS

The invention will be described with reference to a single pass, multi-color thermal printer of the type described in U.S. Pat. No. 5,440,328. In such a printer, a print engine is provided that comprises a media transport system and at least two and preferably three or more thermal print head assemblies or print stations. Each of the print head assemblies includes a respective re-loadable thermal ribbon cassette which is loaded with a color transfer ribbon. Each of the thermal print head assemblies comprises a cantilevered beam, a mounting assembly and a thermal print head having a thermal print line. Each of the print head assemblies has a counterpart platen roller or other platen with which a respective print head forms a respective nip and through which the receiver media and the color ribbon of dye are brought into intimate engagement. The mounting assemblies allow the print heads' positions to be adjusted so that the mounting assemblies can be pivoted towards and away from the respective platen rollers. In this regard, the mounting assemblies are pivotable between an "up" position wherein the print heads are disengaged from the platen rollers and a "down" position wherein the print heads are in biased engagement with the platen rollers.

The reloadable ribbon cassette assembly comprises a cassette body including a ribbon supply roll and a ribbon take-up roll. The ribbon cassette assemblies are preferably each loaded with one of three or more primary color ribbons which are used in conventional subtractive color printing. The supply and take-up rolls of each ribbon cassette assembly are coupled to individual ribbon drive sub-assemblies when the cassette assembly is loaded into the printer for printing images on the media. In addition to an assembly for each of the color ribbons, there may also be provided a ribbon cassette assembly that is provided with a supply of transparent ribbon that can transfer an overcoat layer to the media after an image has been printed thereon. The transparent ribbon cassette assembly is similar in all respects to the other assemblies and a separate print head is used to transfer the overcoat layer to the now imaged receiver. Different types of transparent ribbon may be used to provide matte or glossy finish overcoats to the final print. Alternatively, the print head associated with the transparent ribbon may have the respective recording elements suitably modulated to create different finish overcoats to the final print.

Figure 1:
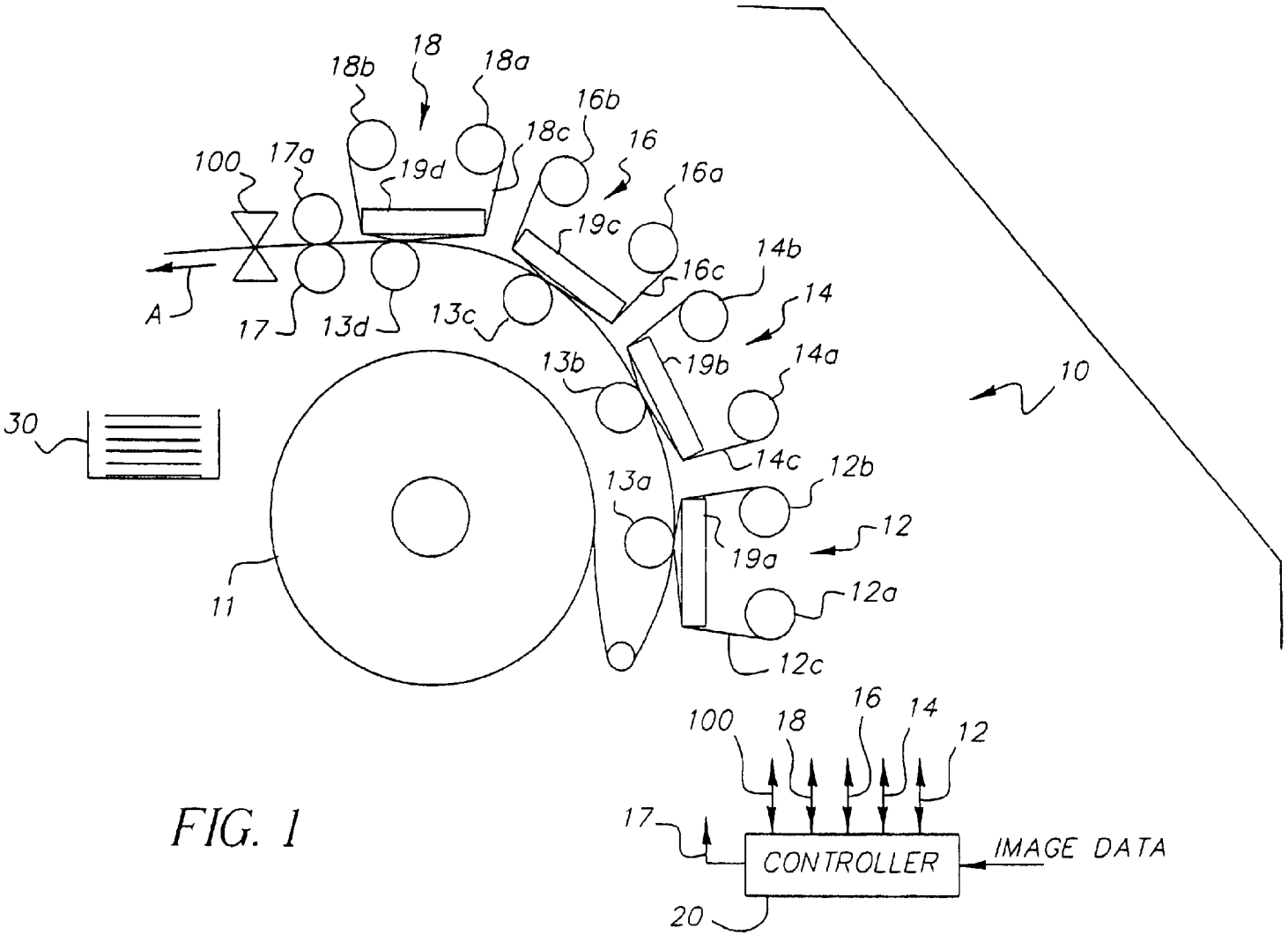
FIG. 1 is a schematic elevational view of a thermal printer made in accordance with the invention.

Referring now to the drawings, there is illustrated in FIG. 1 a single-pass multicolor thermal print engine 10 that may be used in accordance with the teachings of the instant invention. In this regard, reference is made to U.S. application Ser. No. 10/080,139, filed Feb. 21, 2002, in the name of Coons et al., the contents of which are incorporated herein by reference. A receiver media 11 comprising coated paper having a coating thereon adapted for receiving a thermal dye is supported as a continuous roll and threaded about a series of platen rollers 13*a–d*. The receiver media is also threaded through a nip comprised of a capstan drive roller 17 and a pressure roller 17*a*. As the receiver media is driven by the capstan drive roller, the receiver media passes by each thermal print assembly 12, 14, and 16 a respective color dye image is transferred to the receiver sheet to form the multicolor image. For example, the assembly 12 may provide a yellow color separation image, the assembly 14 may provide a magenta color separation image, and the assembly 16 may provide a cyan color separation image to form a three color multicolor image on the receiver sheet. A fourth assembly 18 is provided for thermally transferring the transparent overcoat to protect the color image from for example fingerprints. At each of the four assemblies there is provided a thermal print head 19*a–d* that has recording elements selectively enabled in accordance with image information to selectively transfer color dye to the receiver or in the case of the transparent ribbon to transfer the overcoat layer to the now imaged receiver sheet. After each multicolor image is formed, a cutting device or apparatus 100 may be enabled to cut the receiver media into a discrete sheet containing the multicolor image protected by the transparent overcoat layer. As may be seen in FIG. 1, at each thermal print assembly, there is provided a respective platen roller or other support 13*a–d* which forms a respective printing nip with the respective print head 19*a–d*. Alternatively, a single large platen roller may be used to form separate nips or the platens may be flat instead of rollers. As the receiver sheet is driven through each of the respective nips, the movement of the receiver sheet advances a corresponding thermal ribbon 12*c*, 14*c*, 16*c* and 18*c* through the respective nip as well. Each thermal ribbon is mounted upon a respective cassette assembly that comprises a supply roll (12*a*, 14*a*, 16*a* and 18*a*) and a take-up roll (12*b*, 14*b*, 16*b* and 18*b*).

A print head at each print station engages the respective color donor web or ribbon at the respective print station for selectively heating one surface thereof in response to image information provided to the print head to cause dye to sublimate or to otherwise be transferred to the receiver sheet as the receiver sheet moves continuously from one print station to the next print station wherein the receiver sheet is pulled through the stations by capstan drive roller 17. The thermal print engine 10 also includes a controller 20 which may also include a microcomputer control. The controller 20 receives image data from an external source such as a personal computer, workstation, scanner, fax, digital camera, image memory device, computer network or other source of information signals that is to be printed by the print engine 10. The controller provides control signals to each of the individual print stations, receiver media drive 17 and the cutting device or apparatus 100 at the output end of the thermal print engine. Other types of printers such as ink jet, electrophotographic, etc. may be used for providing the image on the receiver sheet wherein continuous media is to be cut. A suitable collection tray 30 may be provided for collecting the imaged receiver sheets after they are cut from the continuous media.

Figure 2:
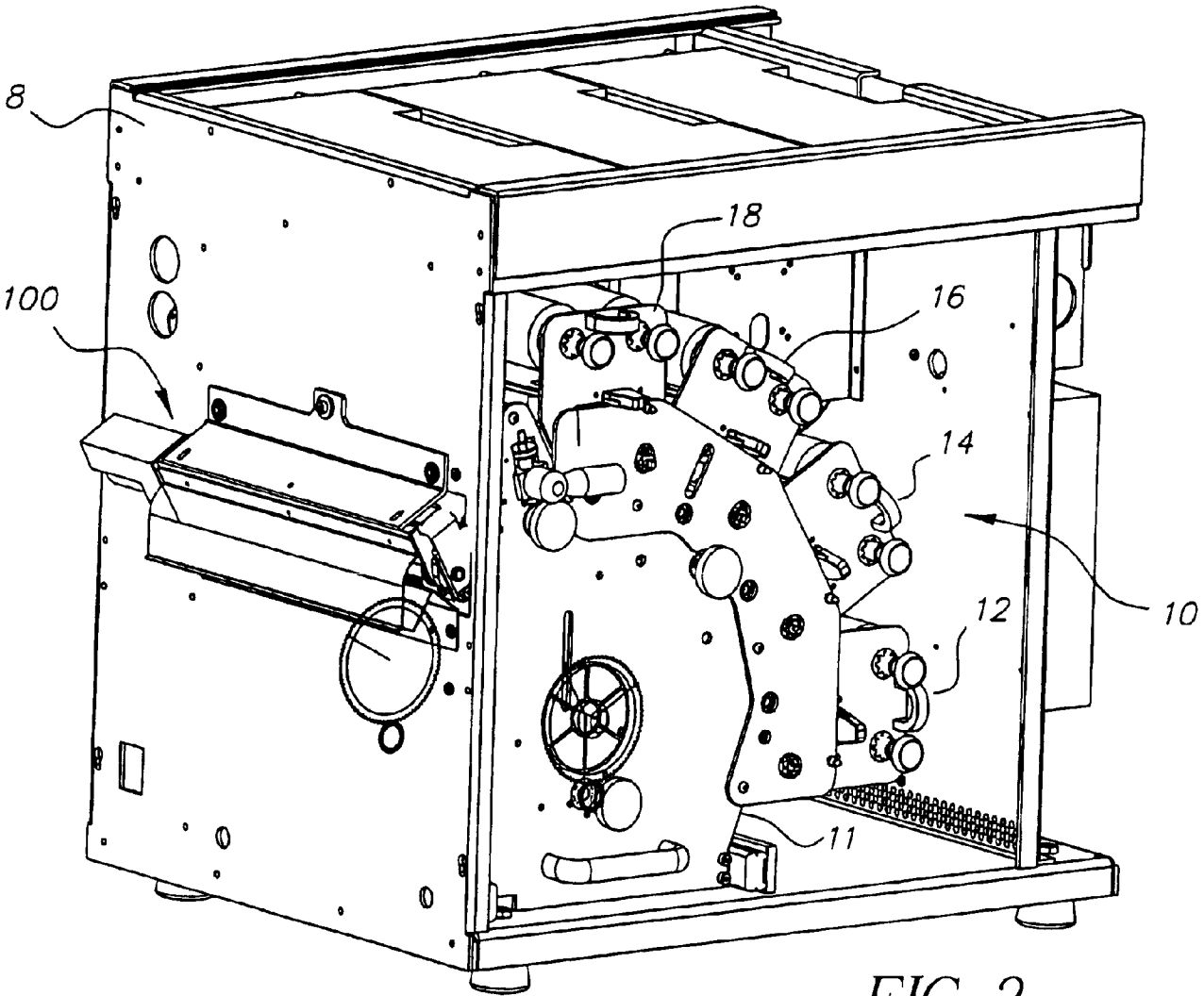
FIG. 2 is a more detailed perspective view of a thermal printer apparatus that includes a cutting and clamping device for use in the apparatus of FIG. 1.
Figure 3:
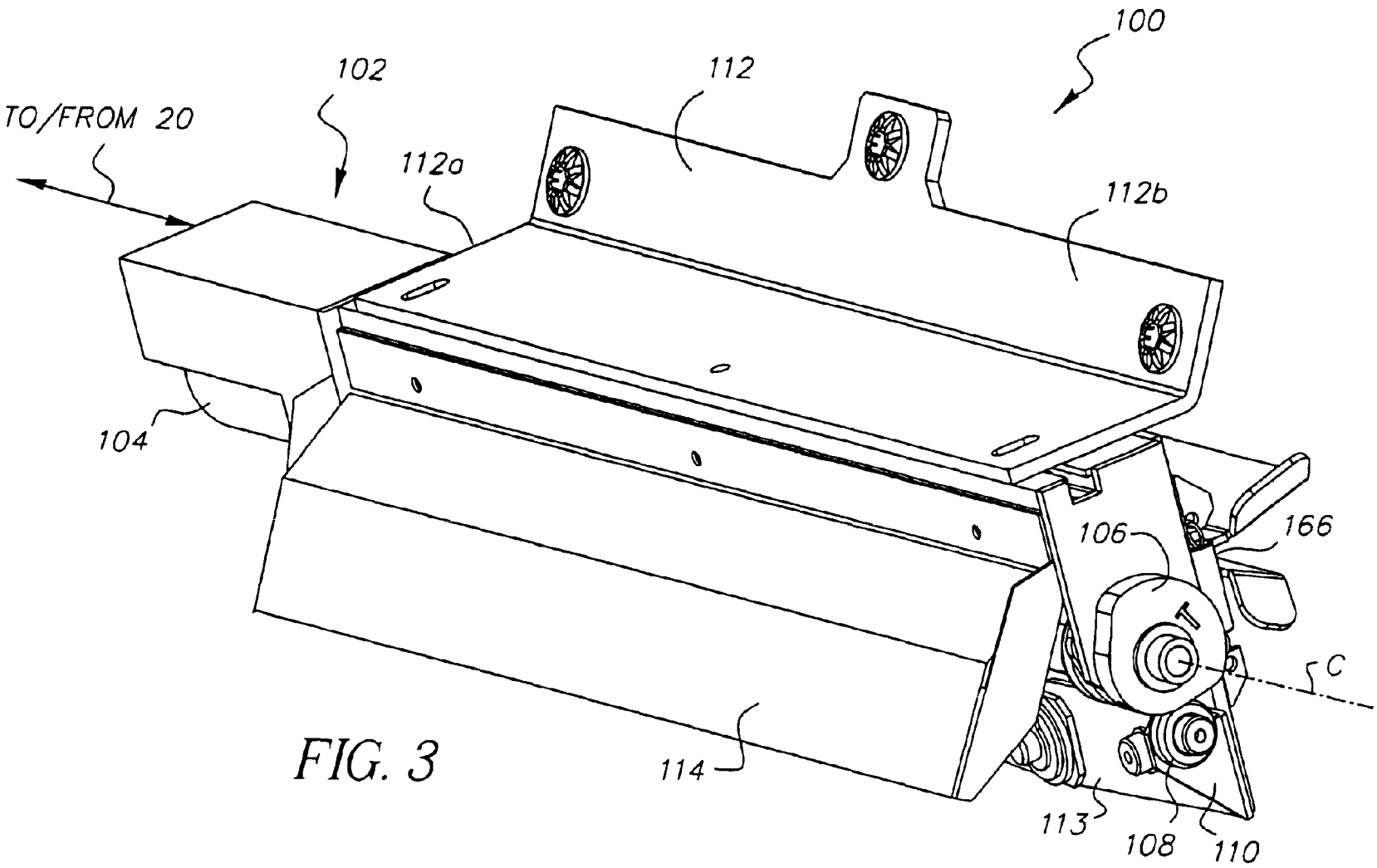
FIG. 3 is a first perspective view of the cutting and clamping device shown in FIG. 2 and illustrating a receiver exit end of the apparatus.
Figure 7:
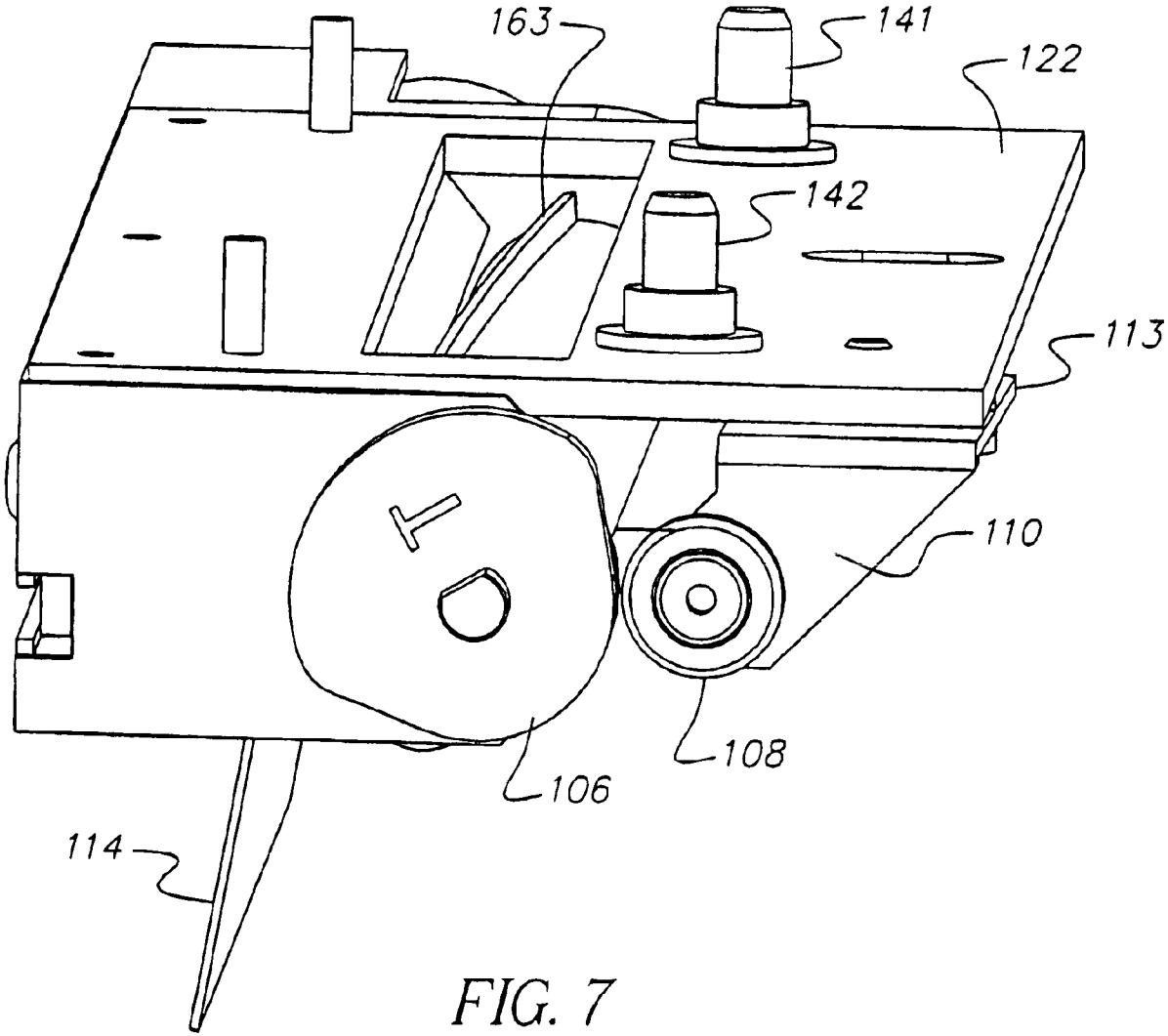
FIG. 7 is a fifth perspective view of the cutting and clamping device with certain elements omitted from the structure shown in FIG. 3 to better illustrate the rotary cutter.

With reference now to FIGS. 2 and 3, there is provided an illustration of a first embodiment of a thermal print engine 10 with a cutting device or apparatus made in accordance with the invention. The cutting apparatus or device 100 is mounted to a printer apparatus housing 8 that encloses the thermal print engine. The cutting device or apparatus includes a conventional rotating cutter device that features a cutter drive motor, a rotating cutter blade 163 (shown in FIG. 7) and a stationary cutter blade (not shown). The stationary cutter blade may be spring loaded to provide some compliance thereto. As the rotating cutter blade 163 traverses transversely (preferably perpendicularly) across the direction of movement of the receiver media, the rotating cutter blade 163 engages the stationary cutter blade with the media (image receiver sheet) located therebetween to cause severing of the receiver media to form a discrete receiver sheet having the image recorded thereon. This severing occurs along a line of sequential cutting action between the rotating cutter blade 163 and the stationary cutter blade.

A cutter housing 102 formed of various connected plates supports the stationary cutter blade and the rotating cutter blade 163 and cutter drive motor. At one end of the cutter housing opposite that of the cutter drive motor 104 there is connected to a shaft supporting the rotating cutter blade 163, a rotary cam 106 that is mounted for rotation about the axis C with the rotating cutter blade 163. The cam 106 engages a rotating cam follower 108 that is supported on a flange 110 that forms part of a lever 113 of a clamping device. The cutting action of the rotating cutter blade 163 with the stationary cutter blade moves in a direction parallel to the axis C. An angle plate 112 has one segment 112*a* thereof connected to the cutter housing and a second segment 112*b* thereof connected to the printer apparatus housing 8 with appropriate bolts. Also connected to the cutter housing is a sheet deflector plate 114 which engages the receiver media and guides it to a bin for collection after the receiver media is cut into a discrete receiver sheet. If desired the sheet deflector plate may be omitted and gravity used to deflect the sheet into the bin.

Figure 4:
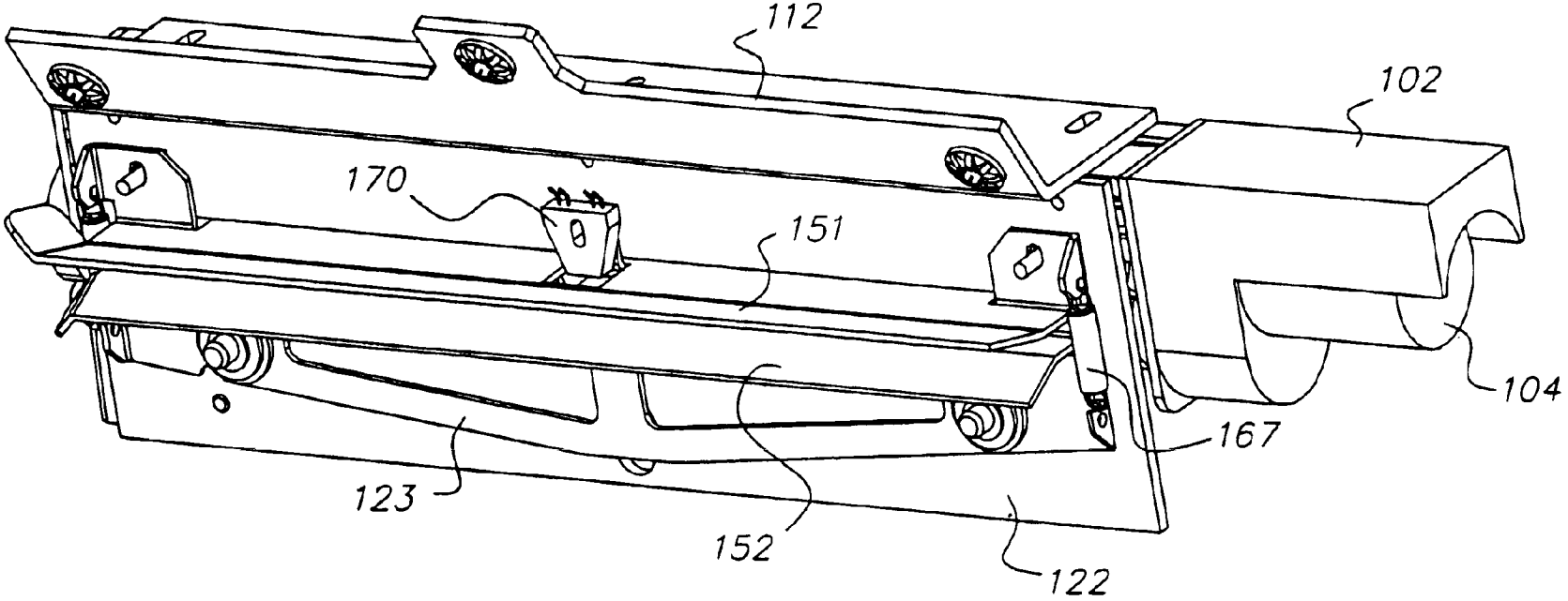
FIG. 4 is a second perspective view of the cutting and clamping apparatus and illustrating an entrance (for the moving receiver sheet) to the clamping and cutting device.
Figure 5:
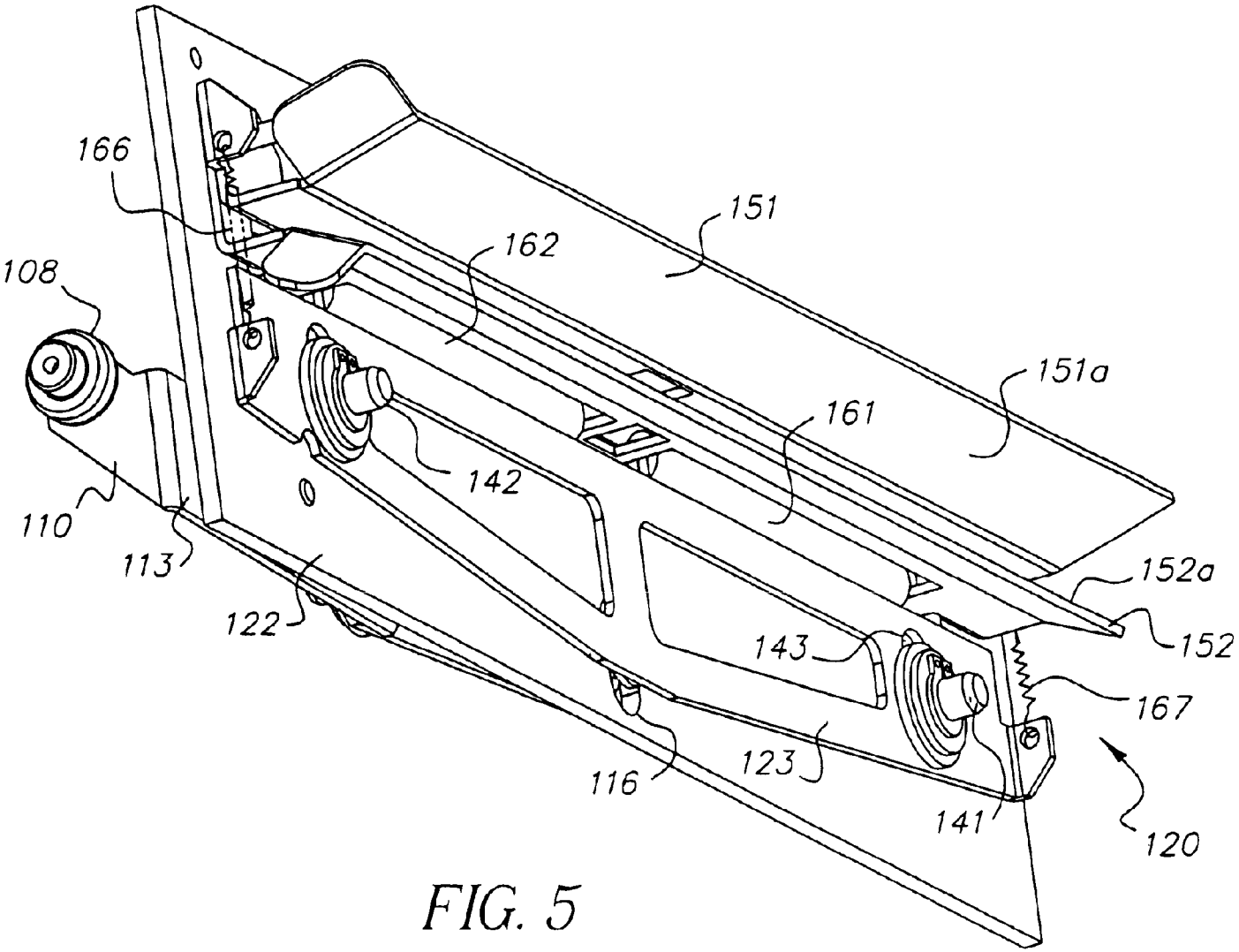
FIG. 5 is a third perspective view of the cutting and clamping device and also illustrating an entrance to the clamping and cutting device.
Figure 6:
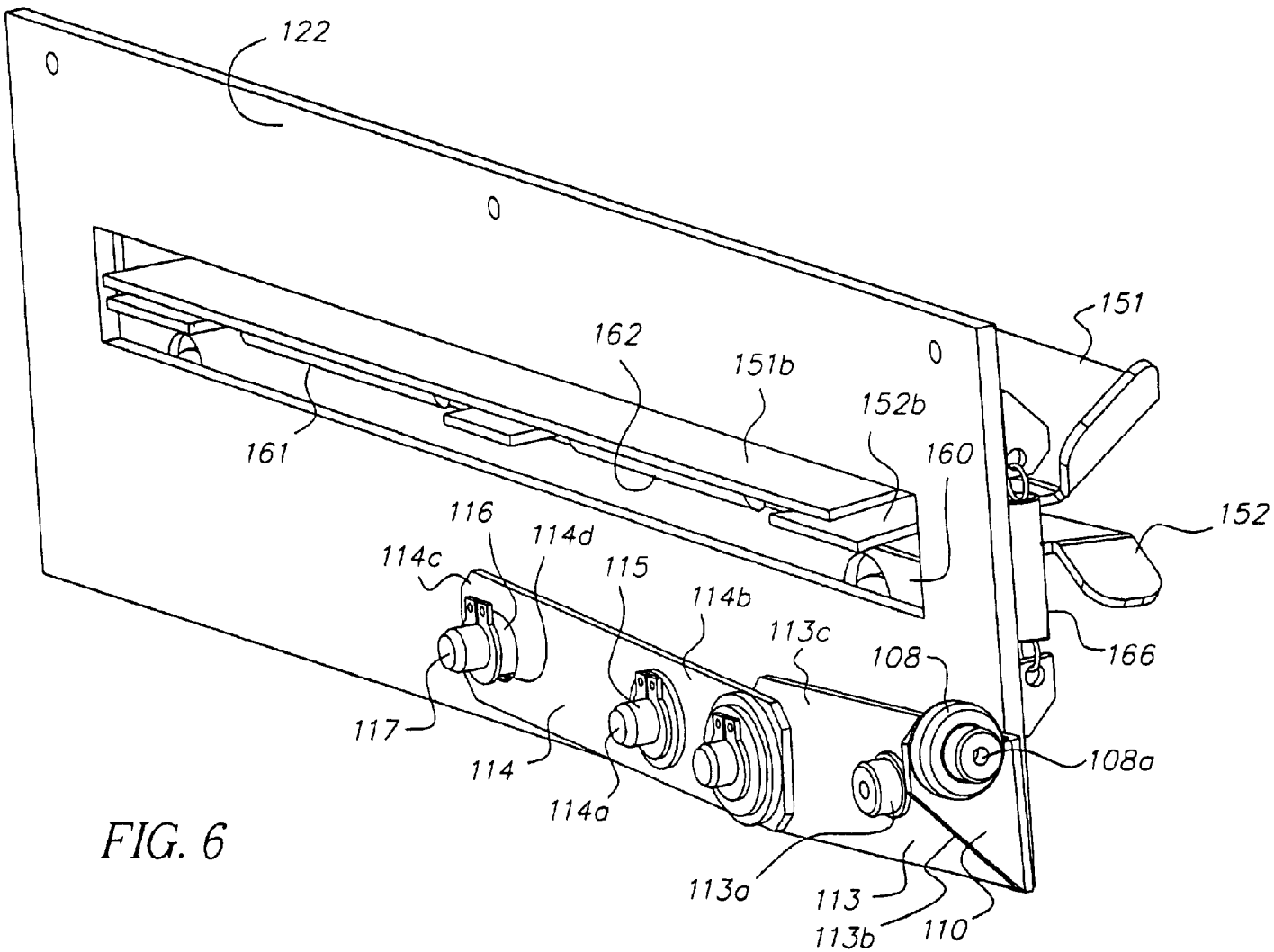
FIG. 6 is a fourth perspective view of the cutting and clamping device with certain elements omitted from FIG. 3 to better illustrate a lever structure used in moving the clamping device.

With reference now to FIGS. 4–6, the clamping device includes a clamp bracket plate 122 which supports on a first side or face thereof first and second levers 113, 114 (FIG. 6) respectively that are each mounted for pivotable movement about a respective pin or stud 113*a*, 114*a*. A cam follower 108 is mounted for rotation about a pin or screw 108*a* that is mounted on a flange 110. The flange 110 is formed integral as a bent portion of the same metal part with the first lever 113 and extends perpendicular to the lever arm 113 of the first end 113*b* of lever 113. A second end 113*c* lever arm 113 is coupled for movement with a first end 114*b* of the second lever 114 by a pin or stud 115 which extends through and in connects the two levers 113, 114 and moves with the two levers. A second end 114*c* of the second lever 114 includes a slot 114*d* through which there is positioned a pin or stud 117 that is integrally connected with a slidable media clamp member 123. A preferred pin is a known type of PEM stud and the studs forming the respective pins are secured in place with conventional retainers as shown.

The clamp bracket plate 122 also supports on a second and opposite side or face thereof the slidable media clamp member 123 for up and down movement. The media clamp member 123 is attached to the second lever 114 through the pin 117 that is pressed fit to the slidable media clamp member 123 and extends through a slot 116 in the clamp bracket plate 122 and as noted above the slot 114*d* in the second lever. The slidable media clamp member 123 is supported near its respective opposite ends to the clamp bracket plate 122 by a pair of PEM studs 141, 142 that are pressed fit into the clamp bracket plate 122 in combination with a retaining ring and washers (nylon and sheet metal) that are associated with each PEM stud. Each of the pair of PEM studs 141, 142 extends through a respective slot 143, 144 formed in the slidable media clamp member 123. The slots 116, 143 and 144 formed in the clamp bracket plate 122 are extended in the direction for up and down movement of the slidable media clamp member 123 in response to pivoting movement of the second lever 114 about the pin 114*a*.

There is rigidly fixed to the clamp bracket plate 122 a pair of media guide brackets 151, 152 having respective upper and lower guiding surfaces for guiding the receiver media into an opening between the slidable media clamp member 123 and a stationary clamp member. The guiding surfaces 151*a*, 152*a* respectively of the media guide brackets have respective extensions 151*b*, 152*b* which fit through a narrow but relatively elongated slot 160 formed within the clamp bracket plate 122. This elongated slot is sufficiently wide to allow the receiver media to pass through the slot and is thus of a length wider than the transverse width of the receiver media. The extension 151*b* on the upper guiding surface comprises the stationary clamp member.

The slidable clamp member 123 includes a pair of tube-like members 161, 162 preferably formed of resilient foam urethane tube material. The lower media guide bracket 152 includes respective openings into which a respective urethane tube is located and supported by tabs (not shown) which are formed integral with the slidable clamp member and extend into end openings of the tube-like members to support them. The resilient urethane tube-like members 161, 162 provide a cushion for the clamp for clamping the receiver media between the tube-like members and the stationary clamp member.

At each of the respective lateral ends of the slidable clamp member 123, there is provided a flange which includes a hole for placement of one end of a respective spring 166, 167. A second end of each respective spring is attached to a respective flange at each of the respective lateral ends of the upper media guide bracket 151. Thus, the slidable clamp member 123 is constrained by the various studs for up and down movement and spring biased towards a closed position for engagement of the resilient urethane tube members with the stationary clamp member. However, during normal operation of the thermal print engine the angular position of the cam 106 is such that the cam follower 108 is positioned such as to urge the slidable clamp member 123 to a position spaced from the stationary clamp member so that the receiver media can move freely through the opening between the slidable clamp member's tube-like members 161, 162 and the stationary clamp member 151*b*. When the controller 20 determines the correct time for cutting of the receiver media, the commencement of rotation of the cutter also causes rotation of the cam 106 and cam follower 108 so as to cause the slidable clamp member's tube-like members 161, 162 to be allowed to move into engagement with the stationary clamp member 151*b*. In this regard the profile of the cam 106 is formed to provide for this movement of the slidable clamp member 123 in accordance with well known principles of cam design. In addition, a sensor 170 is provided through an attachment to the lower guide brackets for sensing if receiver media is present within the slot. Such a sensor may be a photoelectric sensor or other type. A signal from the sensor is communicated to the controller 20 so that no cutting action is provided when no receiver media is present in the cutter area.

In operation the rotary cam 106 (FIG. 3) is locked for rotation with the cutting device and suitably profiled to selectively move the cam follower 108 so that the first and second levers 113, 114 are pivoted to move the slidable clamp member 123 supporting urethane tubes 161, 162 into a clamping relationship with the stationary clamp member 151*b* before, during, and after the cutting operation. More specifically, the cam 106 is designed to start clamping of the moving media at about fifteen degrees worth of rotation of the cam prior to the start of any cutting of the receiver sheet and will start to open up the clamp at about fifteen degrees worth of rotation after the cutting has been completed. This guarantees that the media is held stationary throughout the cutting operation yielding a nice square cut. The cutting action of the rotating cutter blade member is over a longer length than the width of the receiver sheet in the cutter device and is in a linear sequence as the rotating cutter blade member of the rotating cutter member engages the stationary cutter blade member at sequential points so that no cutting action of the receiver sheet occurs for the fifteen degrees worth of rotation before and after the cutting. It will be noted that the pivoting movement of the levers 113, 114 is about an axis parallel to the direction of movement of the receiver media to provide a relatively compact clamping structure.

Although the preferred embodiment illustrates the slidable clamping member as being spring biased towards a clamping position with movement of the clamping member being controlled by the one or more levers, in an alternative embodiment a slidable clamping member may be spring biased away from the clamping position and a pivotable lever used to move the clamping member into the clamping position.

The invention has been described in detail with particular reference to certain preferred embodiments thereof, but it will be understood that variations and modifications can be effected within the spirit and scope of the invention.

What is claimed is:

1. A printing apparatus comprising:

a plurality of printing stations arranged along a path of movement of a receiver sheet moving in a process direction and the printing stations being adapted to record images upon the receiver sheet; and a cutting mechanism having a cutting blade or blades positioned to cut the receiver sheet along a transverse direction to separate a previously printed image on the receiver sheet from a portion of the receiver sheet being currently printed, the cutting mechanism including a clamping member located proximate the cutting blade or blades for stopping movement of the receiver sheet downstream of the clamping mechanism to provide for a substantially square cut relative to the process direction of the receiver sheet, wherein the cutting mechanism includes a rotary cutter blade and a rotary cam member mounted for rotation with the rotary cutter blade; a lever mechanism that includes a cam follower member that engages the cam member; the lever mechanism being coupled to the clamping member to control movement of the clamping member.

2. The thermal printing apparatus of claim 1 and wherein the clamping member is spring biased towards engagement with the receiver sheet and the lever mechanism is operative to control movement of the clamping member out of engagement with the receiver sheet.

3. The printing apparatus of claim 2 and wherein the lever mechanism includes a lever arm that is pivotable about an axis that extends generally in the direction of movement of the receiver sheet in the process direction.

4. In a printing apparatus having a plurality of printing stations arranged along a path of movement of receiver media, a method of severing prints from receiver media being printed, the method comprising:

moving the receiver media in a process direction past the printing stations, the printing stations recording images upon the receiver media; and operating a cutting mechanism having one or more cutting elements to cut the receiver media along a transverse direction to separate a previously printed image on the receiver media from a portion of the receiver media being currently printed, the cutting mechanism including a clamping member located proximate the one or more cutting elements for stopping movement of the receiver media downstream of the clamping mechanism to provide for a substantially square cut relative to the process direction of the receiver media wherein the cutting mechanism includes a rotary cutter blade and a rotary cam member mounted for rotation with the rotary cutter blade; a lever includes a cam follower member that engages the cam member; and in response to rotation of the rotary cutter blade and rotary cam member the cam follower member is moved to cause the lever to pivot wherein pivoting of the lever causes the clamping member to translate into clamping relationship with the receiver media.

5. The method of claim 4 and wherein the clamping member is spring biased towards engagement with the receiver media and the lever operates to control movement of the clamping member out of engagement with the receiver sheet.

6. The method of claim 5 and wherein the lever is pivotable about an axis that extends generally in the direction of movement of the receiver media in the process direction.

7. The method of claim 4 wherein a lever is connected to the clamping member and the lever is pivotable about an axis parallel to the direction of movement of the receiver media past the cutting mechanism to move the clamping member out of engagement with the receiver media.

8. For use with a printing apparatus, a cutter apparatus comprising:

a cutter member adapted to sever a receiver member; and a clamping device through which the receiver member moves in a first direction when not being clamped, the clamping device being adapted to hold the receiver member as the receiver member is being cut by the cutter, the clamping device including:

a lever arm pivotable about an axis that extends generally in the direction of movement of the receiver member;

a movable clamping member for engaging the receiver member to hold the receiver member from movement while the receiver member is being cut by the cutter;

wherein the lever arm is coupled to the clamping member so that pivoting movement of the lever arm causes the movable clamping member to be moved out of engagement with the receiver member.

9. In a printing apparatus having a plurality of printing stations arranged along a path of movement of receiver media, a method of severing prints from receiver media being printed, the method comprising:

moving the receiver media in a process direction past the printing stations, the printing stations recording images upon the receiver media; and operating a cutting mechanism having one or more cutting elements to cut the receiver media along a transverse direction to separate a previously printed image on the receiver media from a portion of the receiver media being currently printed, the cutting mechanism including a clamping member located proximate the one or more cutting elements for stopping movement of the receiver media downstream of the clamping mechanism to provide for a substantially square cut relative to the process direction of the receiver media, wherein a lever is connected to the clamping member and the lever is pivotable about an axis parallel to the direction of movement of the receiver media past the cutting mechanism to move the clamping member out of engagement with the receiver media.

* * * * *